US005279651A

United States Patent [19]

Ramanarayanan et al.

[11] Patent Number: 5,279,651

[45] Date of Patent: Jan. 18, 1994

[54] INORGANIC/ORGANIC INHIBITOR FOR CORROSION OF IRON CONTAINING MATERIALS IN SULFUR ENVIRONMENT

[75] Inventors: Trikur A. Ramanarayanan, Somerset, N.J.; Hyacinth L. Vedage, Bethlehem, Pa.

[73] Assignee: Exxon Research & Engineering Company, Florham Park, N.J.

[21] Appl. No.: 993,261

[22] Filed: Dec. 18, 1992

[51] Int. Cl.[5] ..... C09D 5/08

[52] U.S. Cl. ..... 106/14.17; 106/14.15; 106/14.16; 106/14.21; 106/14.44; 252/390; 252/391; 252/394; 252/395; 427/384; 427/435

[58] Field of Search ..... 106/14.13, 14.14, 14.15, 106/14.44, 14.21, 14.16, 14.17; 252/390, 394, 395, 391; 427/384, 435

[56] References Cited

U.S. PATENT DOCUMENTS

| | | | |
|---|---|---|---|
| 3,939,084 | 2/1976 | Sullivan | 252/391 |
| 4,643,793 | 2/1987 | Nakaso et al. | 106/1.23 |
| 4,763,729 | 8/1988 | Ramanarayanan | 252/8.555 |
| 4,828,615 | 5/1989 | Cape | 106/14.21 |
| 4,889,558 | 12/1989 | Mosser | 106/14.21 |
| 5,064,468 | 11/1991 | Okai et al. | 106/14.21 |

*Primary Examiner*—Anthony Green
*Attorney, Agent, or Firm*—Jay Simon

[57] ABSTRACT

An organic salt, 2,4 Diamino-6-mercapto pyrimidine sulfate, has been combined with oxysalts of group VB or IVB of the periodic table to provide inorganic/organic inhibitor formulations having excellent corrosion resistant characteristics.

10 Claims, 1 Drawing Sheet

INORGANIC/ORGANIC INHIBITOR FOR CORROSION OF IRON CONTAINING MATERIALS IN SULFUR ENVIRONMENT

FIELD OF THE INVENTION

This invention relates to a corrosion inhibitor for iron containing materials in a sulfur containing environment. More particularly, this invention relates to the use of 2,4 diamino-6-mercapto pyrimidine sulfate (DAMPS) as a corrosion inhibitor, and preferably used in conjunction with a Group IVB or VB refractory metal oxide.

BACKGROUND OF THE INVENTION

The production and transportation of predominantly hydrocarbon gases and oils involve the use of iron containing materials which are subject to severe corrosion in sulfur containing atmospheres, particularly at production conditions which may involve temperatures of about 100° F. to 400° F. Recent evidence suggests that corrosion occurs by the rapid migration of iron atoms through an iron sulfide surface film. To control this phenomenon a mixed inorganic/organic inhibitor is employed which changes the bulk chemistry of the sulfide film by suppressing iron migration and providing inhibition by adsorptions on the sulfide surface.

SUMMARY OF THE INVENTION

The corrosion inhibitor of this invention comprises 2,4 diamino-6-mercapto pyrimidine sulfate (DAMPS), preferably in conjunction with a Group IVB (Ti, Zr, Hf) or Group VB (V, Nb, Ta) oxy salt. The metal salt and its use are fully described in U.S. Pat. No. 4,763,729 and is incorporated herein by reference.

We believe that the refractory metal oxy salt is incorporated into the iron sulfide scale formed on the iron alloy and inhibits growth of the scale, while the nitrogen atoms of DAMPS reacts at the surface of the scale, thereby further preventing the migration of iron atoms to the surface and inhibiting the formation of additional iron sulfide scale.

BRIEF DESCRIPTION OF THE DRAWING

The FIGURE shows relative corrosion rates, plotted in mils/year, in the ordinate v. hours in the abscissa, for an uninhibited iron alloy, carbon steel (A), inhibited with DAMPS only (B), inhibited with an oxy salt only (C), and inhibited with a combination of DAMPS and an oxysalt (D).

DETAILED DESCRIPTION OF THE INVENTION

Figure 1:
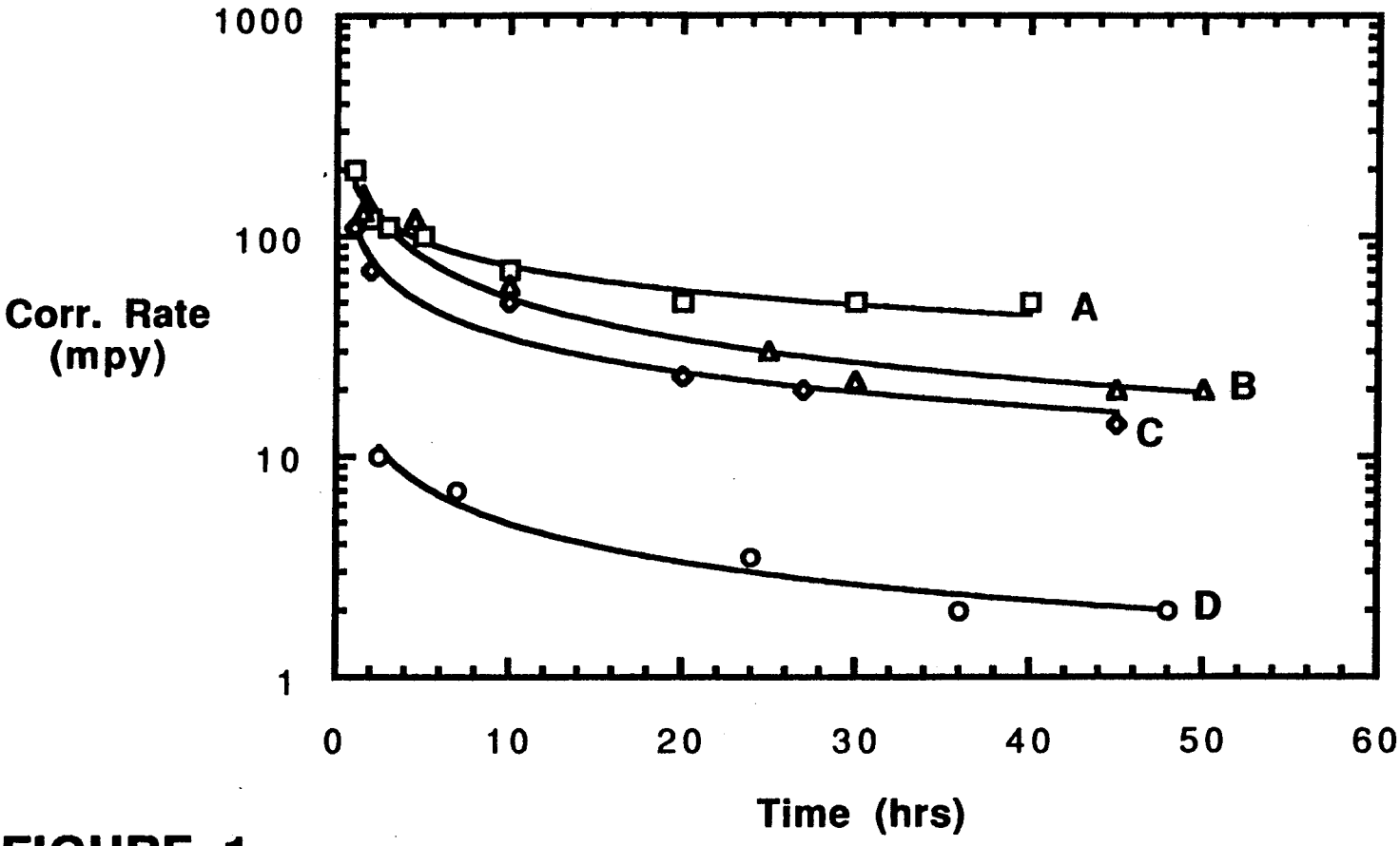

Both the DAMPS, a commercially available chemical, and the metal oxy salt are used in amounts that are effective for inhibiting corrosion, e.g., at least about 10–50 ppm DAMPS, at least about 10–50 ppm of the oxy salt. A solution, preferably an aqueous solution containing appropriate amounts of DAMPS and the oxy salt is easily prepared and applied in known manner to the iron containing alloy to be inhibited. Preferably, DAMPS in an amount of 50–150 ppm, the oxy salt in amounts of about 50–100 ppm are used.

Particularly effective oxy salts are the meta-, ortho-, and pyrovanadates ($NaVO_3$, $Na_3VO_4$, and $Na_4V_2O_7$).

EXAMPLE

Corrosion rates in mils per year for a 4130 series carbon steel were determined by immersing a small example of the material in 3 wt % aqueous sodium chloride solution contained in a pyrex flask fitted with probes for electrochemical corrosion rate measurements. A gas mixture containing 20% hydrogen sulfide in argon was continuously bubbled through the aqueous solution, thus providing the corrosive medium. The results are shown graphically in FIG. 1. The measurements were made at a temperature of 95° C. The 4130 steel is typically comprised of, in wt %, 0.28–0.33 C, 0.4–0.6 Mn, 0.035 max S, 0.15–0.35 Si, 0.8–1.1% Cr, and 0.15–1.25% Mo, the balance being iron.

Curve A shows corrosion rates in mils per year (mpy) for an uninhibited steel, curve B for steel inhibited with 80 ppm DAMPS, and curve C for steel inhibited with 50 ppm of sodium meta vandate. It is observed that both DAMPS and sodium meta vanadate have inhibiting properties, the former providing protection at a level of 58% while the latter provides 70% corrosion protection under conditions used in the experiment described.

Curve D represents the corrosion rate measurement where 80 ppm DAMPS have been combined with 50 ppm sodium meta vanadate. In this experiment, the corrosion rate is seen to be suppressed by 95%. The most interesting point of these examples is that DAMPS and the meta vanadate by themselves are but fair corrosion inhibitors. However, when combining the two, rather than obtaining an average of the two for corrosion inhibition, a substantially enhanced corrosion protection of 95% is achieved.

What is claimed is:

1. A corrosion inhibitor solution for iron containing alloys which comprises a mixture of (A) 2,4 diamino-6-mercapto pyrimidine sulfate and (B) a Group IVB or Group VB oxy salt in amounts effective to inhibit corrosion.

2. The corrosion inhibitor solution of claim 1 wherein (A) and (B) are in an aqueous solution.

3. The corrosion inhibitor solution of claim 1 wherein the oxy salt is selected from the group consisting of metavanadate, orthovanadate, and pyrovanadate.

4. The corrosion inhibitor solution of claim 1 wherein said 2,4 diamino-6-mercapto pyrimidine sulfate is present in said solution in an amount ranging from 50 to 150 ppm and said Group IVB or Group VB oxy salt is present in an amount ranging from about 50 to 100 ppm.

5. A method for inhibiting corrosion of an iron containing alloy comprising treating the alloy with a corrosion inhibiting solution comprising a mixture of (A) 2,4 diamino-6-mercapto pyrimidine sulfate and (B) a Group IVB or Group VB oxy salt in amounts effective to inhibit corrosion.

6. The method of claim 5 wherein (A) and (B) are in an aqueous solution.

7. The method of claim 5 wherein the oxy salt is selected from the group consisting of metavanadate, orthovanadate, and pyrovanadate.

8. The method of claim 5 wherein the oxy salt is metavanadate.

9. The method of claim 5 wherein the iron alloy is steel.

10. The method of claim 9 wherein the steel is carbon steel.

* * * * *